United States Patent [19]

Furuyama et al.

[11] Patent Number: 4,890,592

[45] Date of Patent: Jan. 2, 1990

[54] IGNITION TIMING CONTROL SYSTEM FOR ENGINES

[75] Inventors: Masaaki Furuyama; Kunihiro Abe, both of Tokyo, Japan

[73] Assignee: Fuji Jukogyo Kabushiki Kaisha, Tokyo, Japan

[21] Appl. No.: 247,086

[22] Filed: Sep. 19, 1988

[30] Foreign Application Priority Data

Oct. 1, 1987 [JP] Japan ..... 62-249506

[51] Int. Cl.[4] ..... F02P 5/15

[52] U.S. Cl. ..... 123/417; 123/418

[58] Field of Search ..... 123/415, 416, 417, 418, 123/424, 339

[56] References Cited

U.S. PATENT DOCUMENTS

| | | | |
|---|---|---|---|
| 4,104,998 | 8/1978 | Fenn | 123/415 |
| 4,426,773 | 1/1984 | Nakano et al. | 123/417 X |
| 4,553,517 | 11/1985 | Andreasson | 123/417 |
| 4,790,279 | 12/1988 | Tobinaga et al. | 123/417 |
| 4,827,885 | 5/1989 | Nishikawa et al. | 123/418 X |

FOREIGN PATENT DOCUMENTS 57-59059 4/1982 Japan .

*Primary Examiner*—Willis R. Wolfe

*Attorney, Agent, or Firm*—Martin A. Farber

[57] ABSTRACT

A system for controlling ignition timing of an engine for adjusting ignition timing at an idling state of the engine. An ignition timing fixing switch is provided to produce a fixing signal for providing a fixed ignition timing. A comparator is provided for producing a vehicle driving signal when quantity of fuel injection is larger than a predetermined value which is sufficient for starting a motor vehicle. An AND gate is provided to respond to the fixing signal to produce a first switching signal and respond to the vehicle driving signal to produce a second switching signal. A changeover switch is provided to respond to the switching signal for providing a fixed ignition timing for the adjustment of the ignition timing and to respond to the second switching signal for providing an ignition timing dependent on operating conditions of the engine.

2 Claims, 2 Drawing Sheets

IGNITION TIMING CONTROL SYSTEM FOR ENGINES

BACKGROUND OF THE INVENTION

The present invention relates to a system for controlling the ignition timing of an automotive engine.

The ignition timing must be exactly adjusted, for example at the regular inspection. Generally, the adjustment is performed in idling state by using a timing light under the condition that the ignition timing is fixed to a predetermined value by turning on an ignition timing fixing switch.

However, if an inspector forgets to turn off the ignition timing fixing switch after the adjustment, the ignition timing is kept at the fixed value during the operation of the engine, even if engine operating conditions vary. Accordingly, malfunction of the engine such as miss fire occurs.

Japanese Patent Application Laid-Open 57-59059 discloses a system for resolving the above described problem. In the system, the ignition timing fixing switch which is kept on state is automatically turned off when a motor vehicle is driven. The motor vehicle driving condition is determined in accordance with parameters representing driving conditions such as output signals of an engine speed sensor, mass airflow meter, or intake manifold pressure sensor, vehicle speed sensor, throttle position sensor or position sensor for a select lever.

However, the sensors are liable to deteriorate with time. Accordingly, the system may fail to detect the driving condition when the sensors do not properly operate, resulting in fixing of ignition timing.

SUMMARY OF THE INVENTION

The object of the present invention is to provide a system which may exactly detect driving conditions of a motor vehicle to automatically change the ignition timing fixing state to an ordinary driving state without influence of deteriorations of sensors.

According to the present invention, there is provided a system for controlling ignition timing of an engine for a motor vehicle, comprising detector means for detecting engine operating conditions and for producing output signals dependent on detected conditions, ignition timing calculating means responsive to the output signals for producing an ignition timing signal, fixed ignition timing providing means for producing a fixed ignition timing signal, a fuel injection device for injecting fuel of a quantity dependent on engine operating conditions at an ignition time into cylinders of the engine, and an ignition device for igniting air-fuel mixture.

The system of the invention has means for determining the quantity of the injected fuel and for producing a vehicle driving signal when the quantity is larger than a predetermined value which is sufficient for starting the motor vehicle, an ignition timing fixing switch which is manually operated to produce a fixing signal, gate means responsive to the fixing signal to produce a first switching signal and responsive to the vehicle driving signal to produce a second switching signal, a change over switch responsive to the first switching signal for connecting an output of the fixed ignition timing providing means to the ignition device and responsive to the second switching signal for connecting an output of the ignition timing calculating means to the ignition device.

In an aspect of the invention, the gate means is an AND gate and the fixing signal and the vehicle driving signals are different from each other in logic level.

The other objects and features of this invention will become understood from the following description with reference to the accompanying drawings.

DETAILED DESCRIPTION OF THE PREFERRED EMBODIMENT

Figure 1:
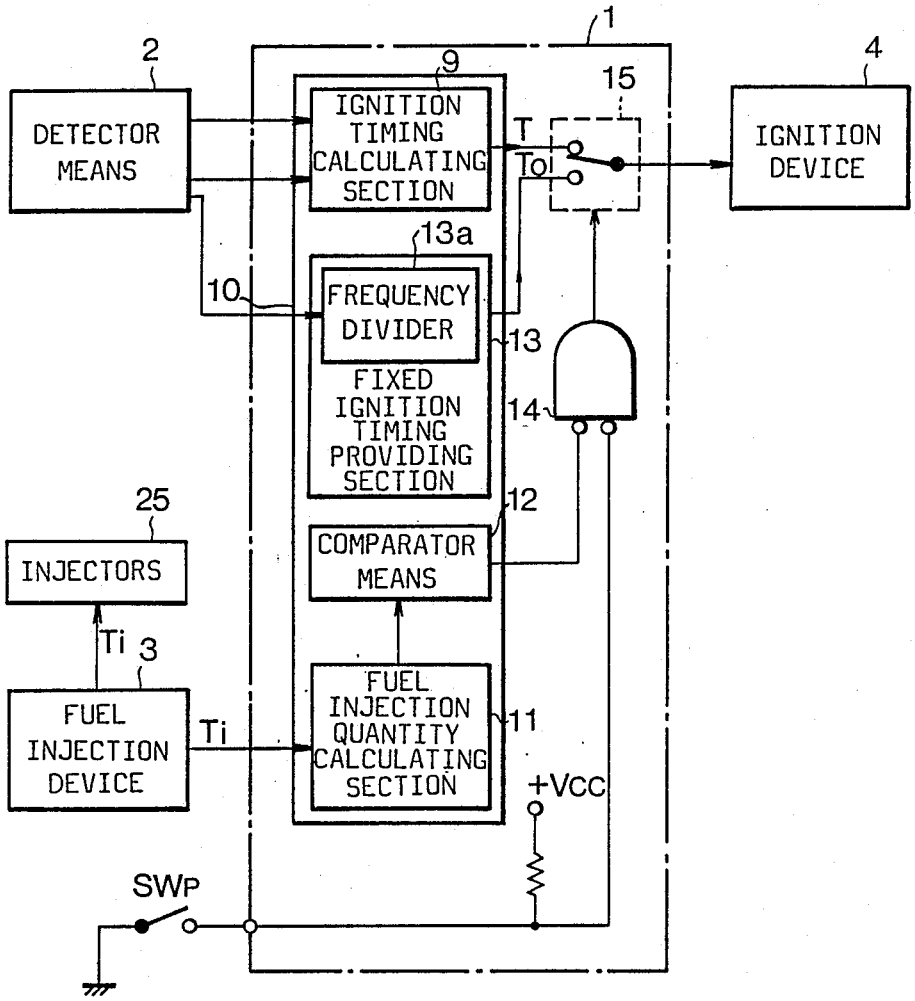
FIG. 1 is a block diagram of an ignition timing control system.

Referring to FIG. 1, an ignition control system 1 for an automotive engine is arranged to receive outputs of an engine operating condition detector means 2 and fuel injection device 3 and to produce an output signal to an ignition device 4.

Figure 2:
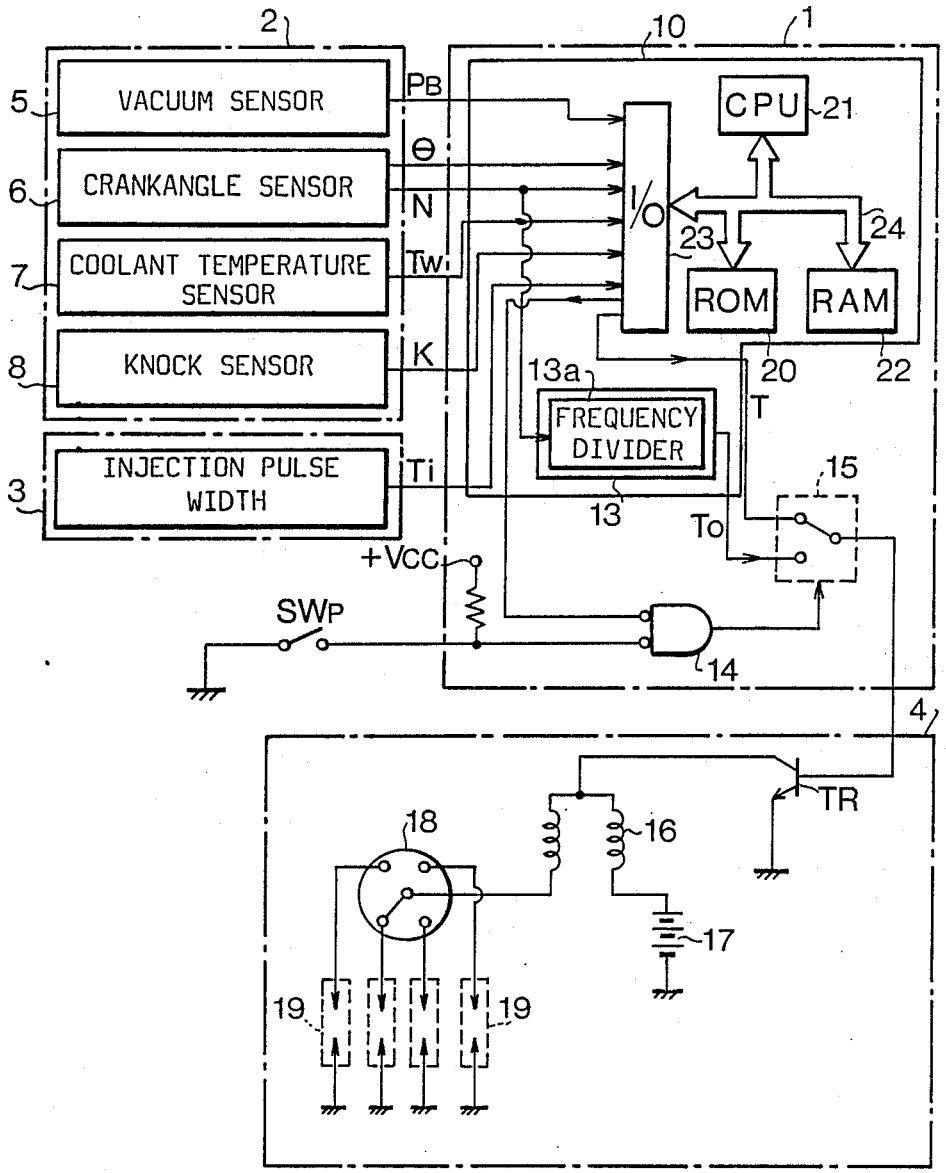
FIG. 2 is a block diagram showing the system of FIG. 1 in detail.

As shown in FIG. 2, the detector means 2 comprises an intake manifold vacuum sensor 5 for sensing the vacuum in the intake manifold at downstream of a throttle valve of an engine, crankangle sensor 6 for sensing the angular disposition of a crankshaft of the engine, coolant temperature sensor 7, and knock sensor 8 for detecting knocking of the engine.

The ignition control system 1 comprises a microcomputer 10. The microcomputer 10 has a CPU 21, ROM 20, RAM 22, I/O interface 23 and a bus 24 connecting with each other. The microcomputer may be functionaly depicted as shown in FIG. 1. Namely the computer 10 comprises an ignition timing calculating section 9, fixed ignition timing providing section 13, actual fuel injection quantity calculating section 11, and fuel injection quantity comparator means 12. The ignition timing calculating section 9 is supplied with an intake manifold vacuum signal $P_B$ from the vacuum sensor 5 and an engine speed signal N from the crankangle sensor 6 to calculate a basic ignition timing. The basic ignition timing is corrected by a coolant temperature signal Tw from the coolant temperature sensor 7, and further corrected by a feedback signal K from the knock sensor 8. The corrected ignition timing signal is applied to the ignition device 4 through a changeover switch 15. The fuel injection device 3 is applied with a fuel injection pulse width signal calculated in the computer 10, for producing a fuel injection pulse width signal Ti for operating fuel injectors 25.

The fuel injection pulse width signal Ti is also applied to the actual fuel injection quantity calculating section 11. The comparator means 12 produces a high level signal when the actual fuel injection quantity applied from the section 11 is larger than a predetermined reference quantity. The reference value is set to a value sufficient to start the motor vehicle, so that the driving condition of the vehicle may be detected. The output signal of the comparator means 12 is supplied to an inverting input of an AND gate 14.

The fixed ignition timing providing section 13 has a frequency divider 13*a*. The frequency divider 13*a* counts pulses from the crankangle sensor 6 to produce a fixed ignition timing signal To which is applied to one of fixed contacts of changeover switch 15.

An ignition timing fixing switch SWp is provided between a source Vcc and the ground so as to apply a low level signal to the other inverting input of the AND gate 14 when closed.

As shown in FIG. 2, the ignition device 4 comprises a transistor TR applied with a signal from the changeover switch 15, an ignition coil 16, a battery 17, a distributor 18, and spark plugs 19.

In normal operation, the ignition timing fixing switch SWp is opened to apply a high level signal to one of the inverting inputs of the AND gate 14. Accordingly, a low level signal is applied to the changeover switch 15 from the AND gate 14, so that the switch connects the ignition timing calculating section 9 with the ignition device 4 as shown in FIG. 1. The ignition timing calculating section 9 calculates an ignition timing based on output signals from the engine operating condition detector means 2 to produce the ignition signal T. The ignition signal T is applied through the switch 15 to the transistor TR to turn on it, thereby exciting the primary coil of the ignition coil 16. When the transistor TR is turned off, the secondary coil of the ignition coil 16 is energized to establish a spark across a spark gap of one of the spark plugs 19. The ignition is sequentially performed to operate the engine.

In ignition timing adjusting operation, a motor vehicle to be adjusted is carried into an auto shop and the engine is idled. The ignition timing fixing switch SWp is closed, so that a low level signal is applied to the input of the AND gate 14. Since the engine is in an idle state, the fuel injection quantity calculated at the calculating section 11, dependent on the fuel injection pulse width signal Ti from the fuel injection device 3 is smaller than the reference quantity. Accordingly, the comparator means 12 produces a low level signal which is applied to the AND gate 14. Thus, the AND gate produces a high level signal, so that the switch 15 is operated to connect the fixed ignition timing providing section 13 with the transistor TR of the ignition device 4. Thus, the engine is operated at the fixed ignition timing applied from the section 13. The ignition timing of the engine is adjusted by using a timing light under such a condition.

After the adjustment of the ignition timing, when the motor vehicle is started, the fuel injection quantity dependent on the fuel injection pulse width signal Ti increases with increase of the load on the engine. Thus, the quantity exceeds the predetermined reference value, so that the comparator means produces a high level signal which is applied to the input of the AND gate 14. Accordingly, the AND gate 14 produces a low level signal to operate the changeover switch 15 to connect the ignition timing calculating section 9 to the ignition device 4. Thus, the engine is operated in accordance with output signals of the detector means 2.

The changeover operation from the ignition timing adjustment state to the ordinary driving state is performed even if the ignition timing fixing switch SWp is not opened, if the motor vehicle is driven. Accordingly, the motor vehicle can be properly driven. Since the driving condition of the vehicle is detected by the change of quantity of injected fuel, the detection is exactly performed without influence of deteriorations of sensors compared with conventional systems.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for controlling ignition timing of an engine for a motor vehicle, comprising:

detector means for detecting engine operating conditions and for producing output signals dependent on detected conditions;

ignition timing calculating means responsive to the output signals for producing an ignition timing signal;

fixed ignition timing providing means for producing a fixed ignition timing signal;

a fuel injection device for injecting fuel of a quantity dependent on engine operating conditions at an ignition time into cylinders of the engine;

an ignition device for igniting air-fuel mixture;

means for determing the quantity of the injected fuel and for producing a vehicle driving signal when the quantity is larger than a predetermined value which is sufficient for starting the motor vehicle;

an ignition timing fixing switch which is manually operated to produce a fixing signal for adjustment of ignition timing;

gate means responsive to the fixing signal to produce a first switching signal and responsive to the vehicle driving signal to produce a second switching signal;

a changeover switch responsive to the first switching signal for connecting an output of the fixed ignition timing providing means to the ignition device and responsive to the second switching signal for connecting an output of the ignition timing calculating means to the ignition device.

2. The system according to claim 1 wherein the gate means is an AND gate and the fixing signal and the vehicle driving signals are different from each other in logic level.

* * * * *